US005309892A

United States Patent [19]

Lawlor

[11] Patent Number: 5,309,892

[45] Date of Patent: May 10, 1994

[54] BLOWER DECK FOR UPFLOW OR DOWNFLOW FURNACE

[75] Inventor: Timothy J. Lawlor, Philadelphia, Pa.

[73] Assignee: American Standard Inc., New York, N.Y.

[21] Appl. No.: 937,326

[22] Filed: Aug. 27, 1992

[51] Int. Cl.[5] ..... F24H 3/02; F24H 3/10

[52] U.S. Cl. ..... 126/110 AA; 126/110 R; 126/116 R

[58] Field of Search ..... 126/99 R, 116 R, 110 R, 126/110 AA, 110 A, 103, 116 A, 116 B

[56] References Cited

U.S. PATENT DOCUMENTS

| | | | |
|---|---|---|---|
| 2,512,384 | 6/1950 | Rush | 126/116 R X |
| 2,529,574 | 11/1950 | Rush | 126/116 R X |
| 2,762,612 | 9/1956 | Druseikis | 126/116 R X |
| 3,394,696 | 7/1968 | Cooper | 126/116 B |
| 4,130,376 | 12/1993 | Dietsche | 126/110 R X |
| 5,060,722 | 10/1991 | Zdenek et al. | 126/99 R X |

*Primary Examiner*—Carl D. Price

*Attorney, Agent, or Firm*—William J. Beres; William O'Driscoll; Peter D. Ferguson

[57] ABSTRACT

An upflow or downflow furnace comprising a housing; a heat exchanger section in the housing, a blower section in the housing, and a blower deck in the housing having an upward side and a downward side. The heat exchanger section includes at least one heat exchanger and the blower section includes a blower for moving air through the heat exchanger section. The blower deck separates the blower section and the heat exchanger section. The blower deck includes an aperture and means, in proximity to the aperture, for either mounting the blower to the downward side of the blower deck for an upflow furnace configuration or mounting the blower to the upward side of the blower deck for a downflow furnace configuration.

15 Claims, 4 Drawing Sheets

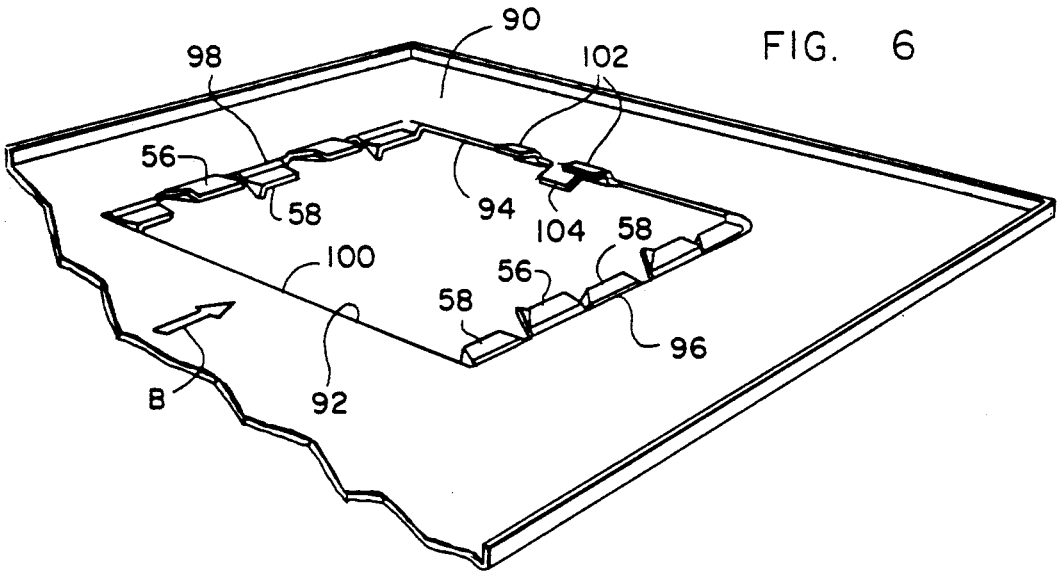
FIG. 6
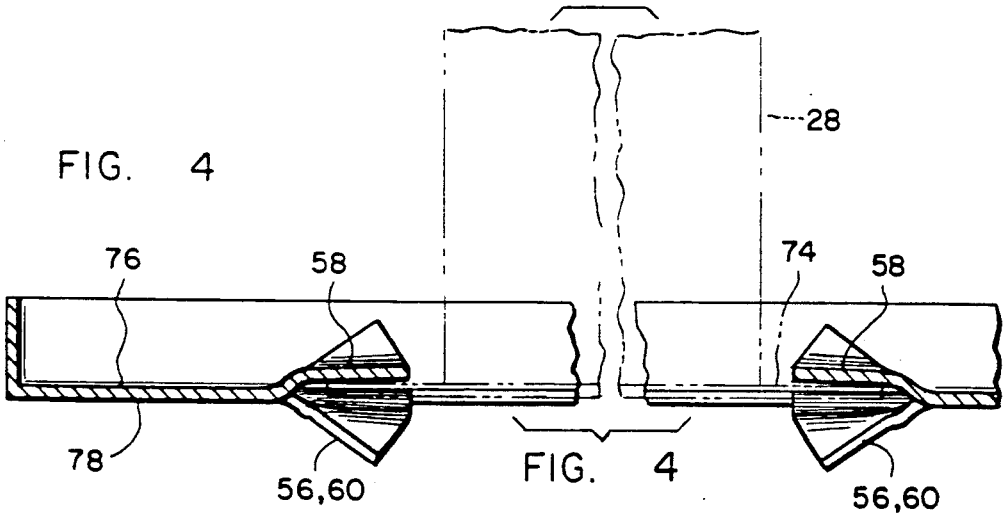
FIG. 4
FIG. 4
FIG. 5
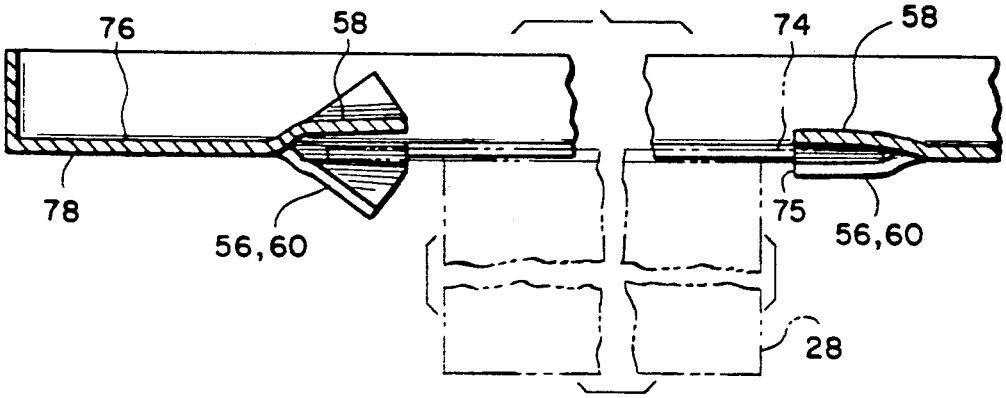

BLOWER DECK FOR UPFLOW OR DOWNFLOW FURNACE

BACKGROUND OF THE INVENTION

The present invention is directed to a heat exchanger for a gas furnace, and more particularly, to a blower deck which can support a blower in either an upflow furnace arrangement or a downflow furnace arrangement.

In previous furnaces two distinct blower decks have been required to supply the separate needs of an upflow furnace and a downflow furnace. An upflow furnace required a blower deck from which the blower hung, while a downflow furnace required a blower deck upon which the blower rested. In these previous arrangements the blower is affixed to the blower deck using spot welded brackets or other cumbersome and time consuming arrangements.

Summary of the Invention

It is an object, feature and an advantage of the present invention to solve the problems of prior art furnaces by providing a single blower deck which can be used in both an upflow or a downflow furnace.

It is a further object, feature and an advantage of the present invention to provide an easily assembled blower deck for a furnace where the blower deck simply slides into a blower deck mounting means.

It is an object, feature and an advantage of the present invention to provide a mounting means which is easily manufactured and which will retain the blower in both an upflow arrangement or a downflow arrangement without the necessity of modifying either the blower deck or the mounting means for either arrangement.

The present invention provides an upflow or downflow furnace comprising a housing; a heat exchanger section in the housing, a blower section in the housing, and a blower deck in the housing having an upward side and a downward side. The heat exchanger section includes at least one heat exchanger and the blower section includes a blower for moving air through the heat exchanger section. The blower deck separates the blower section and the heat exchanger section. The blower deck including an aperture and means, in proximity to the aperture, for either mounting the blower to the downward side of the blower deck for an upflow furnace configuration or mounting the blower to the upward side of the blower deck for a downflow furnace configuration.

The mounting means of the present invention preferably includes a plurality of tabs and the blower includes a flange adapted to engage the plurality of tabs. The blower deck is horizontally arranged, and the plurality of tabs are open at a first end of the aperture to allow the flange to slide into engagement with the tabs. The plurality of tabs includes a first set of tabs raised from the plane of the blower deck, a second set of tabs lowered from the plane of the blower deck, and a third set of tabs located in proximity to a second end of the aperture to act as a stop for the blower deck flange.

In the present invention, the aperture has four sides including a first side associated with the first end, a second side opposite the first side and associated with the second end, a third side interconnecting the first and second sides, and a fourth side opposite the third side and interconnecting the first and second sides. The third set of tabs are connected to the blower deck on the third side of the aperture, and the first and second sets of tabs are each connected to the blower deck on the third and fourth sides of the aperture. Additionally, a first tab of the third set of tabs is connected to the blower deck on the third side of the aperture, and a second tab of the third set of tabs is connected to the blower deck on the fourth side of the aperture.

BRIEF DESCRIPTION OF THE DRAWINGS

FIG. 4 shows a downflow blower installed on a blower deck of the present invention.

FIG. 5 shows an upflow blower installed on a blower deck of the present invention.

FIG. 6 shows an alternative embodiment of the blower deck of FIG. 3.

DESCRIPTION OF THE INVENTION

Figure 1:
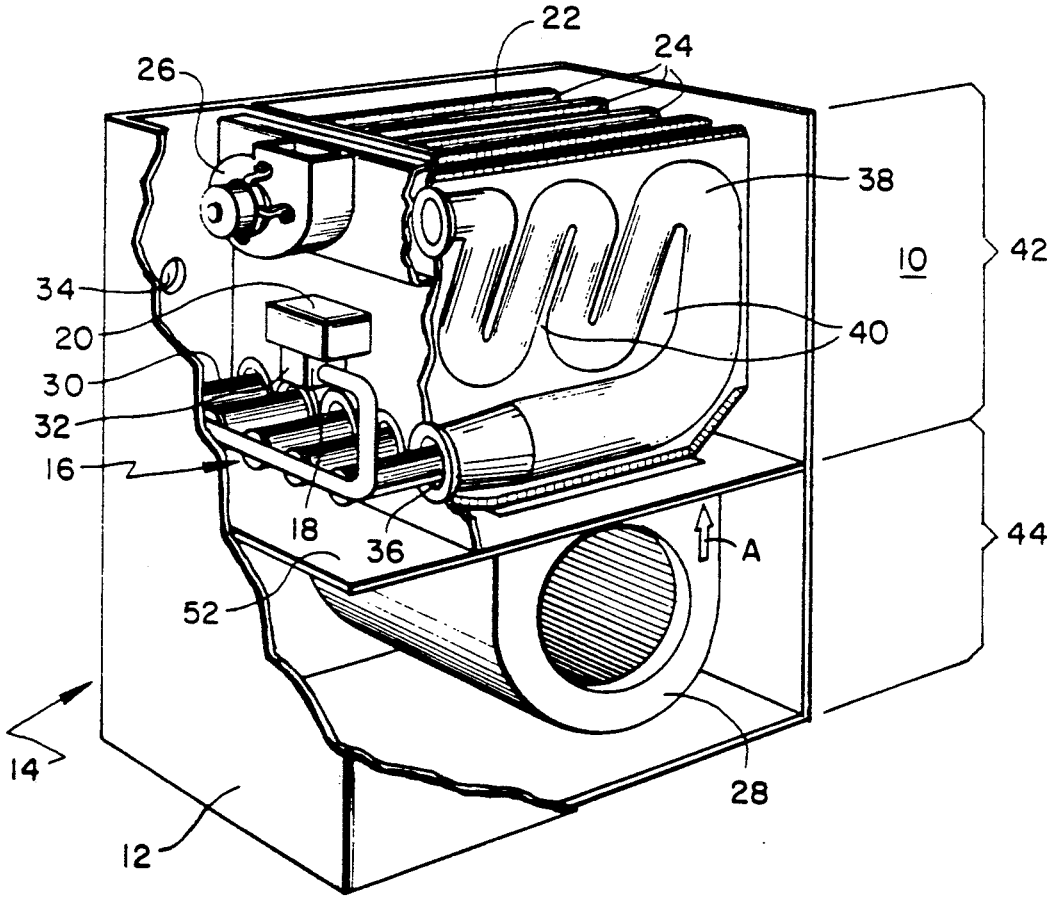
FIG. 1 is a cutaway view of an upflow gas furnace including the blower deck of the present invention.

FIG. 1 shows an upflow gas furnace 10 including a cabinet 12; a combustion system 14 including a burner assembly 16, a gas valve assembly 18 and a control assembly 20; a heat exchanger assembly 22 including a plurality of heat exchangers 24; an induced draft blower 26; and a circulating air blower 28. The circulating air blower 28 blows air in the direction indicated by arrow A.

The burner assembly 16 of the gas furnace 10 includes a plurality of inshot burners 30 manifolded to a supply of fuel gas. The gas valve assembly 18 includes a gas valve 32 which controls the gas supply so that an appropriate air fuel mixture is provided to the burners 30. The air for the air fuel mixture enters through an air inlet 34. Each burner assembly 16 includes a hot surface ignitor 36 to ignite the air fuel mixture. Each burner 30 directs the resultant combustion into one of the plurality of heat exchangers 24. Each burner 30 is in one-to-one correspondence to a particular heat exchanger 24. The heat exchanger 24 includes a serpentine passage 38 which provides maximum heat exchange with forced air from the circulating air blower 28 passing between the plurality of heat exchangers 24 and in the interstices 40 formed by the serpentine passage 38. The induced draft blower 26 pulls the flue gases resulting from combustion through the heat exchangers 24 and vents them to a chimney, a vent or the like (not shown).

The upflow furnace of FIG. 1 includes a heat exchanger section 42 which includes the heat exchangers 24, and a blower section 44 which includes the blower 28. In an upflow furnace the blower section 44 is below the heat exchanger section 42 and blows air to be heated in an upwardly direction, hence the term "upflow" furnace.

Figure 2:
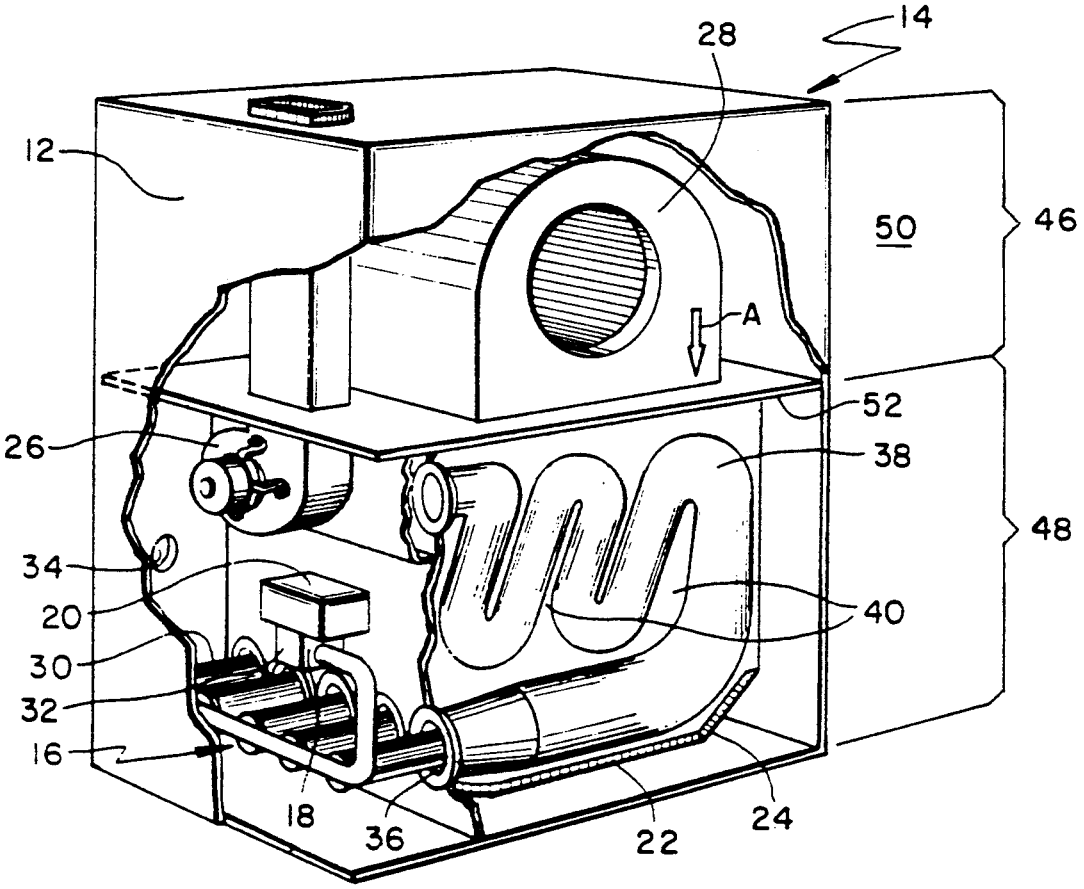
FIG. 2 shows a cutaway view of a downflow gas furnace including the blower deck of the present invention.

FIG. 2 shows a downflow gas furnace 50 which is essentially similar to the upflow gas furnace 10 with the exception that the blower section 46 is mounted above the heat exchanger section 48 so as to blow air downwardly across the heat exchanger section 48, hence the term "downflow" furnace. The arrangement of the elements in the upflow and downflow furnaces is otherwise very similar and like reference numerals are used for the same elements in FIGS. 1 and 2.

Figure 3:
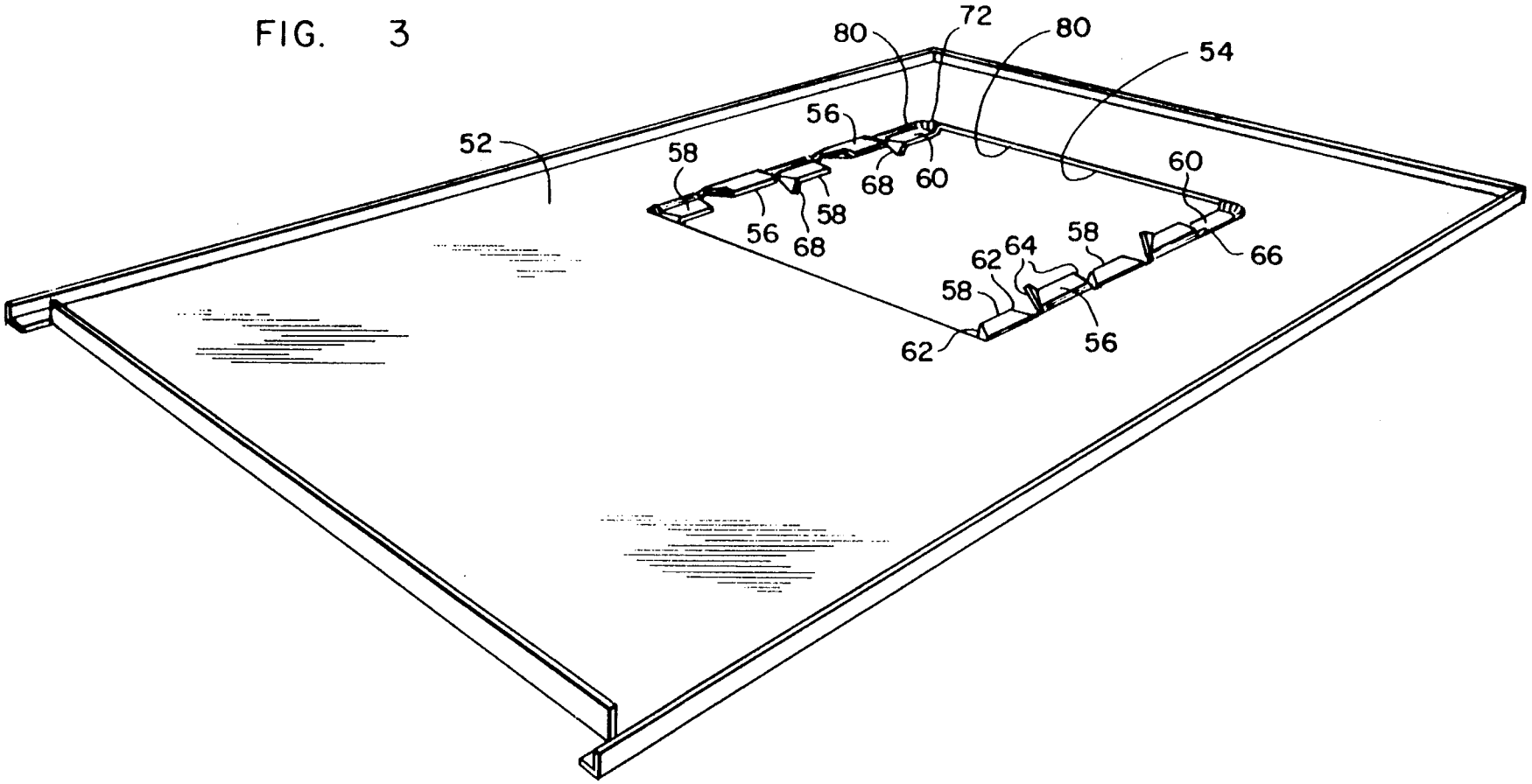
FIG. 3 is a perspective view of the blower deck of the present invention.

Each of the furnaces 10, 50 includes a blower deck 52 which separates the heat exchanger section 42, 48 from the blower section 44, 46. The blower deck 52 is the same for each furnace 10, 50 and is shown in more detail in FIG. 3. The blower deck 52 includes an aperture 54 to allow air to be heated to pass from the blower section 44, 46 to the heat exchanger section 42, 48. The blower deck 52 also includes means for mounting the blower 28 in either the upflow arrangement of FIG. 1 or the downflow arrangement of FIG. 2. This mounting means includes a plurality of tabs 56, 58, 60. As shown in FIG. 3, the tabs 56 are raised from the blower deck 52 while the tabs 58, 60 are lowered from the blower deck 52. The tabs 56 form a first set of tabs, the tabs 58 form a second set of tabs, and the tabs 60 are the preferred embodiment of a third set of tabs. All of the tabs 56, 58, 60 are joined on at least one side to the blower deck 52 and extend into the aperture 54.

Each tab 58 is formed by separating a side 62 of the tab 56 from the blower deck 52 and from the adjacent tabs 56, then lowering the tab 58 from the plane of the blower deck 52. Similarly, each tab 56 is formed by separating the sides 64 of the tab 56 from the adjacent tabs 58, and raising the tabs 56 from the plane of the blower deck 52. In the case of the tabs 60, only a single side 66 of each tab 60 is separated from the adjacent upwardly projecting tab 56. The tab 60 is lowered from the plane of the blower deck 52. Since sides 70 and 72 (shown in dotted outline) of the tab 60 remain attached to the blower deck 52, the tab 60 forms a three dimensional surface which acts as a stop for the blower 28.

The blower 28 includes a flange 74 which, as shown in FIG. 4 and 5, is slid between the upwardly projecting tabs 56, 60 and the downwardly projecting tabs 58. Preferably, a leading edge 68 of each of the tabs 56, 58, 60 is bent away from the blower deck 52 to allow the flange 74 to easily slide. The blower 28 is slid onto the blower deck 52 and between the tabs 56, 58, 60 from the direction shown by arrow B of FIG. 3. In the case of the downflow arrangement shown by FIG. 4 the blower is slid on the upper side 76 of the blower deck 52, while in the case of the upflow arrangement shown in FIG. 5 the blower 28 is slid into the blower deck 52 on the downward side 78 of the blower deck 52. Thus the same blower deck 52 supports the blower 28 in either the upflow furnace or the downflow furnace.

Once the blower 28 is in place on the blower deck 52, the tabs 56, 58, 60 act to retain the blower 28 in position whether the blower 28 is resting on top of the blower deck 52 as shown in FIG. 4, or whether the blower 28 is hanging from the blower deck 52 as is shown in FIG. 5. Although the tabs 56, 58, 60 will support and maintain the blower 28 in position on the blower deck 52, it is preferable to secure the blower 28 to the blower deck 52 by means of bolts, screws or some other conventional arrangement (not shown) so that any operational vibrations will not move the blower 28 relative to the blower deck 52. Additionally, the tabs 56, 58, 60 may be crimped to the flange 74 to strengthen the bond between the blower 28 and the blower deck 52. An example of a crimp 75 is shown in the right side of FIG. 5.

FIG. 6 shows an alternative embodiment of the present invention as exemplified by a blower deck 90. In each of the blower decks 52, 90, the aperture 54 has a first side 92, a second side 94 opposite the first side 92, a third side 96 interconnecting the first and second sides 92, 94, and a fourth side 98 opposite the third side 96 and also interconnecting the first and second sides 92, 94. The first and second sets of tabs 56, 58 are open at a first end 100 of the aperture 54 which is associated with the first side 92. Each of the first and second sets of tabs 56, 58 are each attached to the blower deck 52, 90 on the third and fourth 96, 98 sides of the aperture 54 and projecting into the aperture 54. In the blower deck 52, the tabs 60 represent a third set of tabs which include at least one tab connected to the blower deck 52 on the second and third sides 94, 96 of the aperture 54, and at least a second tab connected to the blower deck on each of the second and fourth sides 94, 98. In the present invention as shown by FIG. 6, the third set of tabs is represented by tabs 102 and 104 where these tabs 102, 104 are connected to the blower deck 90 only on the second side 94 of the aperture 54. To ensure that the third set of tabs 102, 104 will act as a stop in both the upflow and downflow configurations, the tabs 102 are raised from the surface of the blower deck 90, while the tabs 104 are lowered from the surface of the blower deck 90. Thus the third set of tabs, whether represented by the tabs 60 or by the tabs 102, 104, acts as a stop to the blower 28.

Although the present invention has been described in connection with the preferred embodiment above, it is apparent that many alterations and modifications are possible without departing from the present invention. For instance, the tabs are shown as rectangular but clearly could be formed in other shapes such as triangles, ovals or trapezoids. Additionally, the tabs 60 used as stops could be formed and located as rectangular or other shaped tabs in the side 80 of the aperture 54. Also, the tabs are shown as alternately and symmetrically raised or lowered from the blower deck. Clearly, the tabs could be asymmetrically arranged such that the angle of raise varies from the angle of lowering. Additionally, the sequence and directions in which the tabs are arranged can be varied. It is intended that all such alterations and modifications be considered within the spirit and scope of the invention as defined in the following claims.

I claim:

1. An upflow or downflow furnace comprising:

a housing;

a heat exchanger section in the housing, the heat exchanger section including at least one heat exchanger;

a blower section in the housing, the blower section including a blower for moving air through the heat exchanger section;

a blower deck in the housing having an upward side and a downward side, the blower deck separating the blower section and the heat exchanger section, the blower deck including an aperture and means in proximity to the aperture, for either mounting the blower to the downward side of the blower deck for an upflow furnace configuration wherein air is blown upwardly across the heat exchanger section, the heat exchanger section being located on the upward side of the blower deck or mounting the blower to the upward side of the blower deck for a downward furnace configuration wherein air is blown downwardly across the heat exchanger section, the heat exchanger section being located on the downward side of the blower deck.

2. The furnace of claim 1 wherein the mounting means includes a plurality of tabs and the blower includes a flange adapted to engage the plurality of tabs.

3. The furnace of claim 2 wherein the plurality of tabs include a first set of tabs raised from the plane of the blower deck and a second set of tabs lowered from the plane of the blower deck.

4. The furnace of claim 2 wherein the first and second tab sets alternate and the angles of raising and lowering are nonsymmetrical.

5. The furnace of claim 2 wherein the first and second sets of tabs alternate and the angles of raising and lowering are symmetrical.

6. The furnace of claim 3 wherein the blower deck is horizontally arranged.

7. The furnace of claim 6 wherein the plurality of tabs are open at a first end of the aperture to allow the flange to slide into engagement with the tabs.

8. The furnace of claim 7 wherein the plurality of tabs includes a third set of tabs located in proximity to a second end of the aperture to act as a stop for the blower deck flange.

9. The furnace of claim 8 wherein the aperture has four sides including a first side associated with the first end, a second side opposite the first side and associated with the second end, a third side interconnecting the first and second sides, and a fourth side opposite the third side and interconnecting the first and second sides.

10. The furnace of claim 9 wherein the third set of tabs are connected to the blower deck on the third side of the aperture, and the first and second sets of tabs are each connected to the blower deck on the third and fourth sides of the aperture.

11. The furnace of claim 10 wherein a first tab of the third set of tabs is connected to the blower deck on the third side of the aperture, and wherein a second tab of the third set of tabs is connected to the blower deck on the fourth side of the aperture.

12. The furnace of claim 7 wherein at least some of the plurality of tabs includes a leading edge which is bent away from the blower deck.

13. The furnace of claim 7 wherein the plurality of tabs are crimped into engagement with the flange.

14. An upflow or downflow furnace comprising:

a housing;

a heat exchanger section in the housing, the heat exchanger section including at least one heat exchanger;

a blower section in the housing, the blower section including a blower for moving air through the heat exchanger section;

a horizontally arranged blower deck in the housing having an upward side and a downward side, the blower deck separating the blower section and the heat exchanger section, the blower deck including an aperture and a plurality of tabs, in proximity to the aperture, for either mounting the blower to the downward side of the blower deck for an upflow furnace configuration wherein air is blown upwardly across the heat exchanger section, the heat exchanger section being located on the upward side of the blower deck or mounting the blower to the upward side of the blower deck for a downflow furnace configuration wherein air is blown downwardly across the heat exchanger section, the heat exchanger section being located on the downward side of the blower deck;

the blower including a flange adapted to engage the plurality of tabs;

wherein the plurality of tabs are open at a first end of the aperture to allow the flange to slide into engagement with the tabs; and wherein the plurality of tabs includes a first set of tabs raised from the plane of the blower deck, a second set of tabs lowered from the plane of the blower deck, and a third set of tabs located in proximity to a second end of the aperture to act as a stop for the blower.

15. The upflow furnace of claim 14 wherein the aperture has four sides including a first side associated with the first end, a second side opposite the first side and associated with the second end, a third side interconnecting the first and second sides, and a fourth side opposite the third side and interconnecting the first and second sides;

wherein the third set of tabs are connected to the blower deck on the third side of the aperture, and the first and second sets of tabs are each connected to the blower deck on the third and fourth sides of the aperture; and wherein a first tab of the third set of tabs is connected to the blower deck on the third side of the aperture, and wherein a second tab of the third set of tabs is connected to the blower deck on the fourth side of the aperture.

* * * * *